United States Patent [19]

Newman, Sr. et al.

[11] Patent Number: 4,721,066

[45] Date of Patent: Jan. 26, 1988

[54] SELF-ADJUSTING FAIL SAFE FRICTION HEATER SYSTEM

[75] Inventors: William E. Newman, Sr., 207 Doncaster Rd., Joppa, Md. 21085; Desmond J. Farrow, Sr., North East, Md.

[73] Assignee: William E. Newman, Sr., Joppa, Md.

[21] Appl. No.: 939,851

[22] Filed: Dec. 9, 1986

[51] Int. Cl.[4] ..... F22B 3/06

[52] U.S. Cl. ..... 122/26; 126/247; 237/1 R

[58] Field of Search ..... 122/11, 12, 26; 237/1 R; 126/247

[56] References Cited

U.S. PATENT DOCUMENTS

| | | | |
|---|---|---|---|
| 1,713,502 | 5/1929 | Steps | 126/247 X |
| 1,768,716 | 7/1930 | Shishkoff | 126/247 X |
| 2,090,873 | 8/1937 | Lazarus | 122/26 |
| 4,004,553 | 1/1977 | Stenstrom | 122/26 X |
| 4,424,796 | 1/1984 | Fish | 122/26 X |
| 4,454,861 | 6/1984 | Grenier | 122/26 X |
| 4,501,231 | 2/1985 | Perkins | 122/26 |
| 4,554,906 | 11/1985 | Newman, Sr. et al. | 122/26 |
| 4,596,209 | 6/1986 | Haslach, Jr. | 122/26 |

FOREIGN PATENT DOCUMENTS

| | | |
|---|---|---|
| 286747 | 12/1914 | Fed. Rep. of Germany . |
| 2927659 | 1/1981 | Fed. Rep. of Germany . |

*Primary Examiner*—Steven E. Warner

*Attorney, Agent, or Firm*—John F. McClellan, Sr.

[57] ABSTRACT

An improved friction heater with driveshaft that rotates one frictional part relative to another interfitted with it provides, on the driveshaft, screw-and-inertia member to release frictional force between the frictional parts when the frictional parts are being stopped, permitting use of a less powerful drive for start-up and lighter structural support. The interfitted frictional parts are conical in shape and also have automatic-driveshaft release to prevent overheating from wear at the frictional interface after long use. The release provision includes a slot in the lower part of the rotor and a transverse pin in the driveshaft, that engages the slot for normal driving operation. When as result of wear, the relative axial position of rotor and housing changes sufficiently to pass out of the range of normal operation, the slot and pin automatically and correspondingly pass from engagement with each other. For maximum heat transfer from friction heater to copper tubing carrying heat-transfer fluid, the exterior of the housing has novel helically juxtaposed semi-circular grooves fitting a helix of copper tubing. Heat exchange and hydraulic drive are also disclosed.

11 Claims, 6 Drawing Figures

SELF-ADJUSTING FAIL SAFE FRICTION HEATER SYSTEM

FIELD OF THE INVENTION

This invention relates generally to systems for heating and specifically to a friction heater of the type having a rotor operating in contact with a housing with fluid heat transport.

BACKGROUND OF THE INVENTION

Friction heater systems have been used with many sources of energy for convenient heating, water-wheels and windmills being examples; particularly in testing, electric motors have been used.

In the prior art, systems have been disclosed in patents for friction heating including the following U.S. and foreign patents;

U.S. Pat. No. 2,090,873 issued to A. Lazarus on 8-24-37 showed conically interfitted friction members for producing hot water or steam using a boiler or tank and a drive motor;

U.S. Pat. No. 4,004,553 issued to L. A. Stenstrom on 1-25-77, showed varieties of a motor driven rotor in a casing shaped with the general contours of the rotor, for heat generation in a fluid by shearing action. FIG. 8 in particular showed a generally conical cup-like rotor, small end down, and similar cup-like conical rotor in FIG. 6 and rounded cup-like conical shape in FIG. 7;

West Germany Pat. No. 2,927,659, July 9, 1979, Jan. 29, 1981, showed truncate-cone interfitting male and female, the male spring-biased; fluid inlet and outlet appear in a boiler-like surround for the female;

Germany Pat. No. 286,747, Dec. 31, 1914; Aug. 27, 1915, showed a conical friction member, evidently manually operated for warming a cup of fluid.

U.S. Pat. No. 4,554,906 issued 11-26-85, to the present inventors for TANKLESS FRICTION BOILER SYSTEM disclosed interfitting cylindrical friction members in a friction heating system.

However, regulation of a system of the type described in vertical embodiments which have advantageous features, has proved to be difficult. Both wear rates and frictional loading can be uneven and can produce, at best, hard starts and other inefficiences in the equipment and in results, and at worst, vibration, seizures and destructive overloads and equipment failure.

SUMMARY OF THE INVENTION

Principal objects of the invention are to provide an improved system of the type having conically interfitting male and female friction members, the male being a rotor and the female a stationary housing.

Other objects of the invention are to provide a system as described that prevents hard starts automatically, reliably and simply without need for sensors or servos and that reduces the engine power requirement and stress on the system resulting from seizing so that more economical construction and operation can result.

A further object is to provide a system as described that has a safety release that acts to uncouple the drive when wear of friction surfaces has reached a predetermined limit.

Still further objects are to provide a system as described that transfers heat efficiently and that is suited for high pressure use and is easily inspected and repaired when necessary.

The invention provides an improved vertical axis system of the type having male conical rotor rotating in female cone, including improved heat transfer by fluid, improved failsafe wear mechanism, improved power transmission and improved conical element structure.

BRIEF DESCRIPTION OF THE DRAWINGS

The above and other objects and advantages of this invention will become more readily apparent on examination of the following description, including the drawings in which like reference numerals refer to like parts.

DETAILED DESCRIPTION

Figure 1:
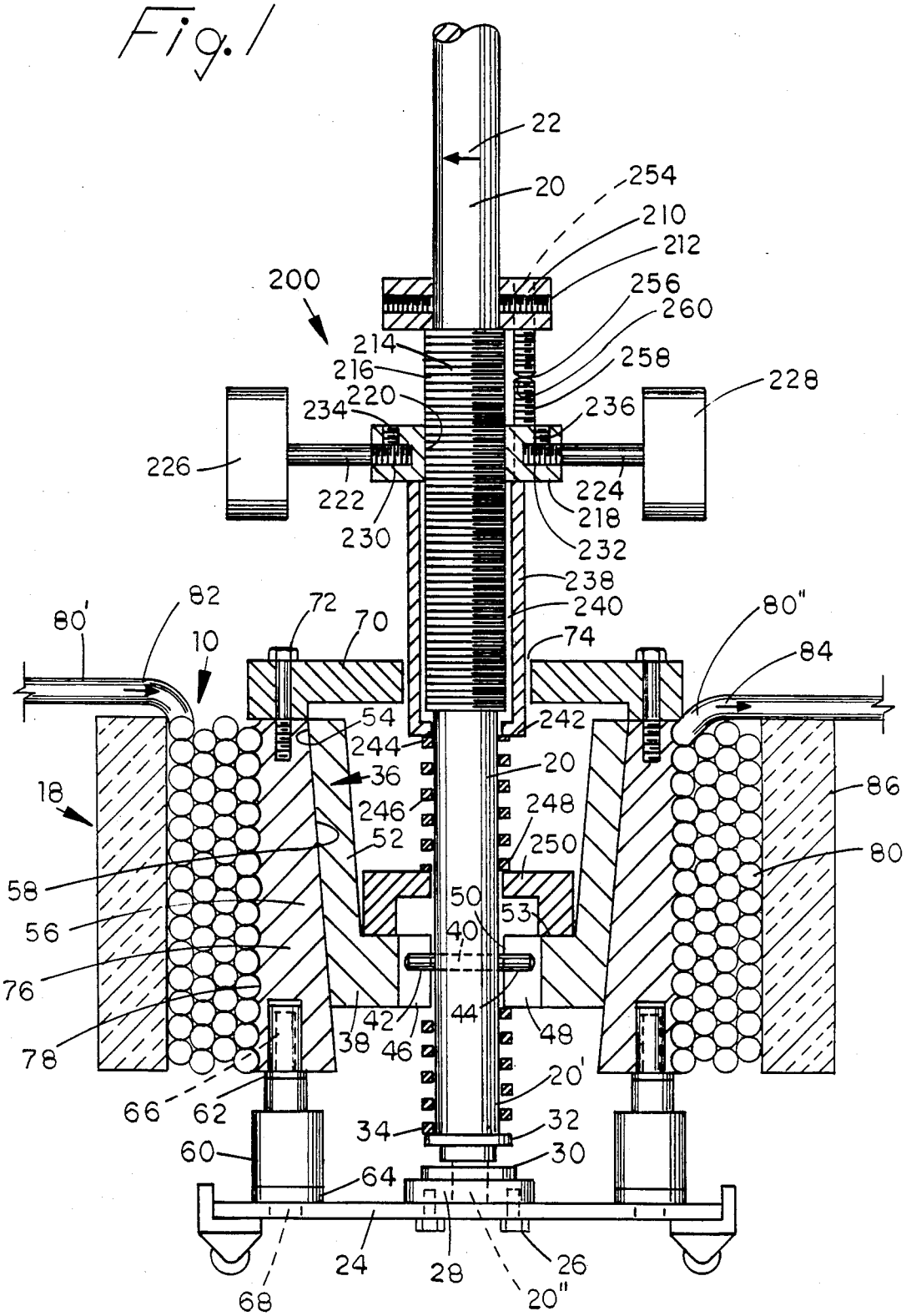
FIG. 1 is an elevational, partly sectional diagrammatic view of a portion of the system in a preferred embodiment.

FIG. 1 shows general details of embodiment 10. In the friction heater 18, drive shaft 20 may be driven by any convenient source of power such as a waterwheel, windmill, or other, represented by arrow 22.

The drive shaft may be conventionally supported as by a base plate 24 to which is held by screws 26, a self-aligning flange bearing 28 that may be any suitable commerically available bearing receiving the stepped-down lower end portion 20'' of the drive shaft 20 conventionally engaging thrust washer stepped portions 30, 32.

Thrust washer portion 32 fits on the end portion 30 and supports the lower end of compression spring 34 that coaxially surrounds the higher, full-diameter portion of the drive shaft 20 and helps support or "float" the weight of a cup-shaped co-axial, friction element or rotating drum 36 by bearing against the flat bottom 38 of the drum. This provision is part of means for adjusting this support, by substitution of thinner or thicker washers 30, 32.

For drive release purposes that will be explained, the drive shaft 20 rotates the drum 36 by means of a drive pin 40 that is fixed transversely through the drive portion 20 along a diameter.

The protrusive ends 42, 44 of the pin 40 slidably engage respective slot portions that pass through the bottom of the cup as lateral extensions 46, 48 of bore 50, in which the driveshaft rides freely.

The rotating drum 36 is in the shape of a truncate cone or thimble, with uniform-thickness conically inclined wall 52. The exterior conical male surface 54 of the drum 36 fits uniformly within the female fixed member or housing 56, that has a bore 58 of the same conical dimension as the exterior wall 54 of the drum 36, or bore.

The angle of the conical wall with respect to the bore may be from 7° to 45° and preferably is about 10°.

Four equally-spaced adjustable-length legs 60 of conventional design with bushings 62, 64 of heat-resistant thermoplastic such as "Kevlar" brand or other commerically available thermoplastic held by coaxial, threaded ends 66, 68 adjustably support the housing 56 but insulate against heat loss. These are part of means for adjusting the contact between the drum or rotor and the housing or stator at the friction interface. The bushings can be substituted by thicker or thinner bushings.

A top plate 70 held by machine screws 72 closes of the top of the housing except for hole 74 that passes the driveshaft and an associated part of a drive pressure adjustment provision.

DRIVE PRESSURE ADJUSTMENT

To prevent the conically inclined surfaces from seizing, chattering or overstressing, and to reduce the load on them and associated apparatus, especially when starting up after cooling has had the opportunity to force them together, requiring excessive torque to start relative rotation, an effective and simple improvement is provided as an independent, easily installed automatically operating subassembly 200.

A length of the shaft 20 has adjustably fixed on it by a clamping ring 210 with set screws 212, an intergal sleeve 214 exteriorly threaded as at 216 and extending downwardly from the clamping ring 210.

On the threaded sleeve 214 is a nut 218 with threads 220 that fit the sleeve threads 216 freely. The nut 218 has diametrically opposed first and second inertia arms 222, 224 with respective weights 226, 228, the arms being radially disposed from respective holes 230, 232 in the nut and held by clamping screws 234, 236 that fit the inertia arms and adjustably fix them in-and-out.

To the nut 218 is affixed a second sleeve 238. The second sleeve 238 is coaxial with the first sleeve 214 and extends downwardly over it with clearance 240 between. At the lower end it may have an inward flange 242 but in any case the lower end abuts the upper end 244 of a second coil spring 246 on the shaft 20 below it. The second coil spring lower end 248 abuts a collar 250 that surrounds the driveshaft 20 and rests on the inside bottom portion 53 of the rotation drum.

An adjustment set screw 254 is threaded through the clamping ring 210 and has a rounded lower end 256 protrusive downwardly from the clamping ring 210. A similar adjustment set screw 258 is threaded upwardly through the nut 218 and has a rounded upper end 260.

OPERATION OF THE PRESSURE RELIEF MECHANISM

It will be seen that the spring forces of springs 246 and 34 oppose.

The mechanism 200 serves to relieve pressure at the interface 54/58 by reducing compressive force on the upper end 244 of spring 246 automatically when the system is coming to rest, and to increase compressive force at the interface 54/58 when the system starts up again.

The amount or pressure change is in each case presettable to desired value.

When the shaft 20 and drum or rotor 52 stop, the inertia members (weights) 226, 228 causes the nut 218 to continue to rotate. Assume that rotation of the shaft is clockwise (arrow 22) and that threads 216 are left-hand threads. The nut will rise until the end of screw 258 striked the end of screw 256 at the adjustment set, and stops it, both screws being on the same radius.

Rising of the nut 218 relieves pressure on spring 246 so that spring 34 will buoy-up the drum or rotor 52. When the system starts up again, the opposite will occur, the inertia of the nut will cause relative rotation on the threaded sleeve to lower the nut, compressing spring 246 and forcing the drum or rotor 52 down. Adjustment for the upper limit of travel of the nut is, as noted, by means of the two screws 254, 258. Adjustment of the lower limit is by loosening the set screws 212, moving the subassembly 200 up or down, and re-tightening the set screws.

The generally cylindrical exterior wall 76 of the housing 56 has a helical groove 78 coaxially around it. The groove shape is half-circular in cross-sectional view and the grooves are contiguous. Wound around the helix is copper tubing 80 with fluid circulated inside for heat transfer. Four wound layers of copper tubing are preferred, permitting fluid to flow in at the top as at arrow 82 and also out at the top as at arrow 84. Insulation 86 may extend down to the base plate 24 and may cover the top plate 70 of the housing and cover the copper tubing inlet and outlet runs 80', 80" to prevent heat loss. Size of tubing and length are given below. The tubing is wound tight and may be sealed with heat-transfer paste.

The rotating drum and the housing may be of gray iron for smooth operation at the conical interface 54/58 in relative rotation to generate heat.

OPERATION OF DRIVE RELEASE PROVISION

Figure 2:
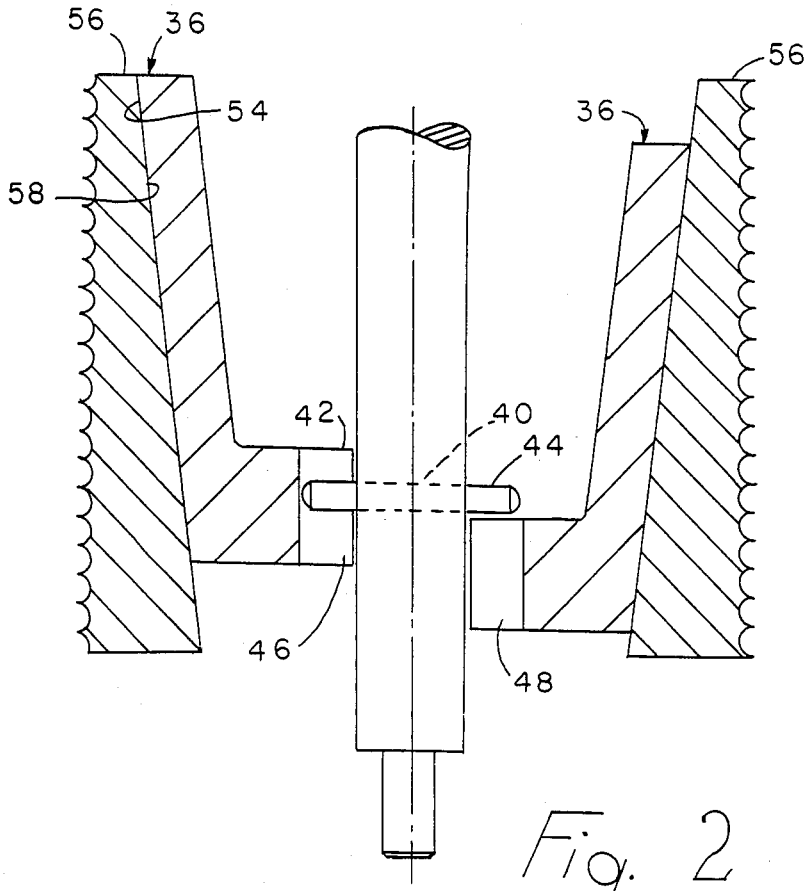
FIG. 2 is a sectional elevational diagram split along the centerline to show two positions of a drive release provision.

FIG. 2 diagrams at the left of centerline the relative drive positions of the drum 36 and drive pin 40 and housing 56 when the drum is unworn. At the right is shown the position of these elements when the drum 36 (and/or housing 56) is worn, the drive pin 40 in the first case, left of centerline, being shown in drive position with the protrusion 42 and slot 46 shown. In the second case, protrusion 44 has been released by drum wear from engagement with the slot 48, automatically.

Said in another way, as the mechanism operates, over a period of time the conical interface 54, 58 will wear and the drum 36 will ride lower in the housing 56 until it exceeds the range of axial position in which it is designed to operate. To assure safety at the extreme heat generated (300° F.), particularly as the friction surface-area decreases, the slot portions 46, 48 will lower and free themselves from the drive pin 40 and the drive can continue to rotate without generating heat. The range of normal drive operation may be several pin-diameters.

Figure 3:
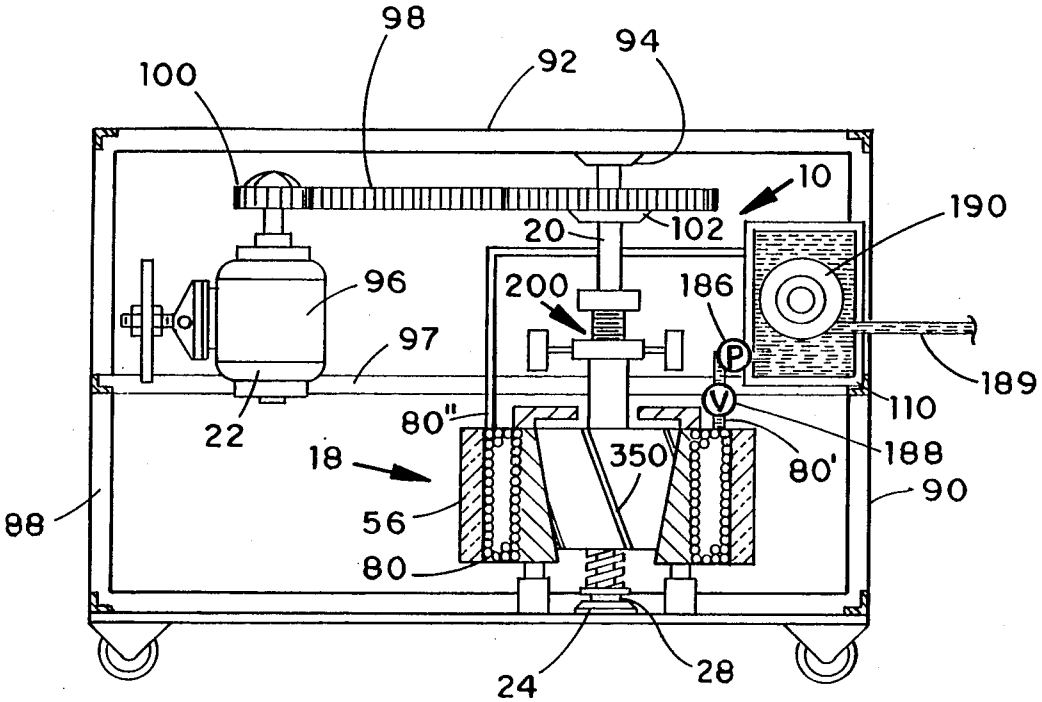
FIG. 3 is an elevational diagram of the system.
Figure 4:
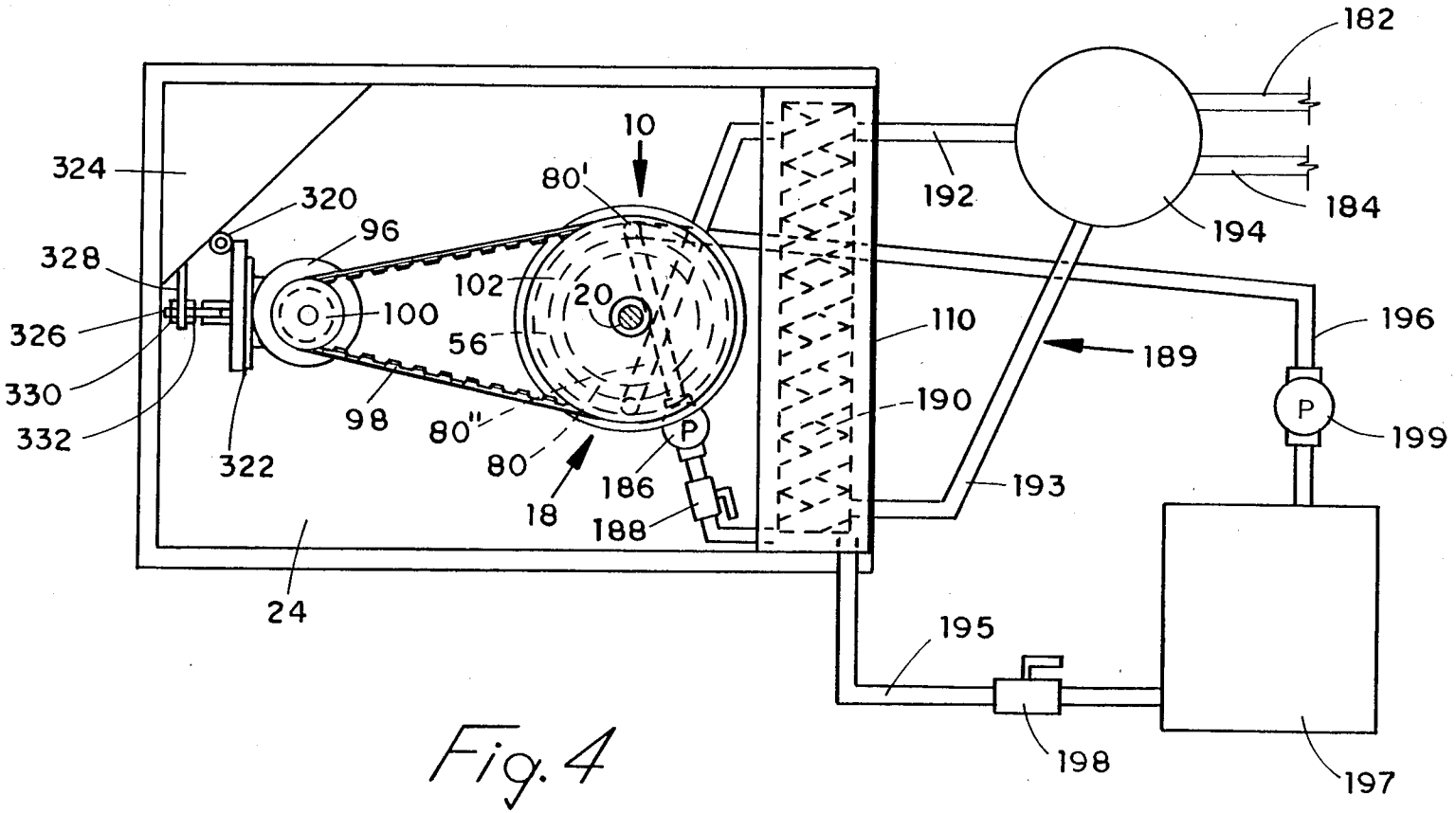
FIG. 4 is a top plan diagram thereof with a portion removed for exposition.

FIGS. 3 and 4 show in side elevational view and top paln view respectively, the general relation of the elements of a system employing the embodiment 10 of friction heater 18.

The base plate 24 may mount the mechanisms by machine screws, and similarly may mount upright frame portions 88, 90 that hold a horizontal frame portion 92 that extends past and holds the driveshaft 20 in a bearing 94.

Drive means such as electric motor 96 shown, mounted on a second horizontal member 97 may conventionally drive the driveshaft 20 as by a belt 98 and pulleys 100, 102 (or, if desired, by hydraulic pump and motor or the like). Any suitable conventional means may be used.

There may be various loops in the heating system. As an example, heated fluid may pass from the friction heater coils 80, in through line 80" to heat exchange reservoir 110 and then out through return line 80' and back into the friction heater coils for reheating. Preferably a pump 186 is provided in this loop, and a valve 188 for shutoff, as in summer.

Transferring heat from fluid in the reservoir 110 for domestic hot water use may be a closed circuit 189 with a coil 190 immersed in the fluid and circulating through lines 192 and 193 through a conventional heat exchange tank 194 with separate intake and discharge lines 182, 184.

For winter heating, lines 195 and 196 may convey hot fluid from the heat exchange reservoir through a conventional hot water furnace 197 and return, suitable summer shut down valve 198, and a pump 199 being provided.

Indicated in FIG. 3 at 200 is the previously described self-adjusting mechanism for relieving pressure between the friction heater parts on shut-down and restoring it on start-up.

Also shown in FIG. 4 are a conventional belt tightening system of hinge 320 pivotally carrying the motor mount 322 relative to a frame member 234, and a threaded protrusion 326 of the motor mount passing with clearance through a strut 328 to which the threaded protrusion adjusts by nuts 330, 332 on either side.

Finally, indicated in FIG. 5 (and at 350, FIG. 3) is the further anti-seizing feature 350 that helps provide uniform rotation of the rotor in the housing at high temperatures, as described below.

Figure 5:
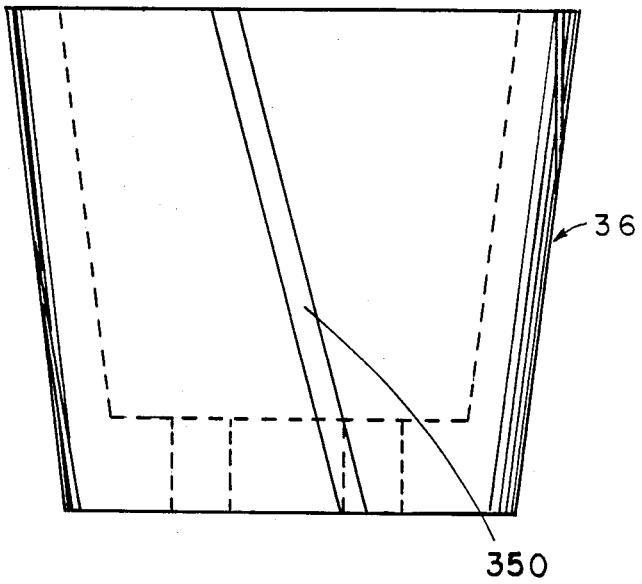
FIG. 5 is an elevational view of a conical rotor on a larger scale.
Figure 6:
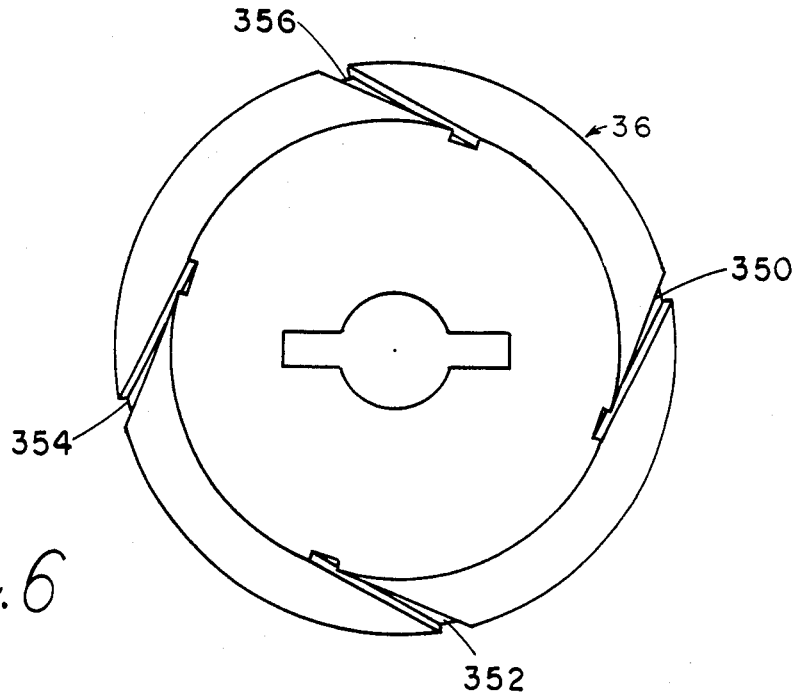
FIG. 6 is a plan view thereof.

FIGS. 5 and 6 detail this anti-seizing feature as being in the form of four grooves, 350, 353, 354, 356, around the conical exterior of the friction heater drum or rotor 36. These are preferably three-sixteenth inch (3.7 cmm) deep and on a fifteen degree incline from the parallel to the conical exterior, and extend through each end of the conical exterior.

The fifteen degree incline is counter to the direction of rotation of the friction rotor, so that the grooves take in air for lubrication at the leading end of the grooves at the large end of the conical shape, and discharge it at the small end.

Material for the embodiment may be mild steel, other than as noted, except that for low thermal conductivity the base may be of maple hardwood or the like.

Dimensions may include the following:

angle of conical walls with respect to the axis or gore, 7 degrees to 45 degrees, with 10 degrees preferred;

compression springs: 2 inch (5 cm) 1.0 by 3½ inch (8.8 cm) long by 50 lb./inches (23 kg/cm) spring constant;

insulation: 1" (2.5 cm) thick fibreglass, minimum all over;

housing length: 10 inches (25 cm)

housing minimum wall thickness: 1 inch approx. (2.5 cm)

drum conical wall thickness: 1 inch approx. (2.5 cm)

drum bottom or transverse wall thickness: 2 inches (5 cm)

drum length: 8½ inches driveshaft diameter, upper portion: 1¾ inch (35 mm)

motor rating: 5 hp copper tubing inside diameter: 0.5 inch (13 mm)

pmp capacity: 180 ft. (54 m)

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States letters patent is:

1. A system for friction-heating of fluid for use at a remote location, and having: a housing with an interior wall of conical contour and an exterior wall, tubing on the housing for heating of fluid therein by the housing, a driveshaft, a rotor with an axis of rotation and an exterior wall of conical contour fitting the housing interior wall in position for rotation of the rotor by the driveshaft relative to the housing causing heating of said rotor and housing; and means for transferring fluid heated, characterized by: means for connecting the rotor for rotation by the driveshaft within a predetermined range of relative positions of rotor and housing along said axis, means for automatically disconnecting said connecting of the rotor from the drive shaft when said predetermined range is exceeded, said rotor being subject to wear relative to said housing by said rotation and causing said range to be exceeded, the means for connecting comprising: the driveshaft having a lower portion with a transverse structure thereon, the rotor having structure defining an axial slot, the transverse structure being in a range of driving positions within the axial slot, and the means for disconnecting comprising said wear causing said rotor to descend relative to the housing and the axial slot to lower with said descent and remove said transverse structure from with the axial slot.

2. A system as recited in claim 1, said housing exterior wall having a continuous helical groove of juxtaposed semi-circular cross-sectional form thereon in position for receiving said tubing for said heating of fluid.

3. A system as recited in claim 1, a furnace system, and first and second heat exchangers for transferring heat from said tubing on the housing to a said furnace system.

4. A system as recited in claim 1, a plate covering said rotor and attached to said housing.

5. A system as recited in claim 1, means for supporting a portion of the weight of the rotor for adjusting said friction heating, comprising a compression spring around the driveshaft and below the rotor in position for exerting a lifting force on the rotor from beneath.

6. A system as recited in claim 5, a base, the compression spring having a lower end, the lower end supported on said base, and means for adjusting said supporting comprising a plurality of height-adjustable legs holding the housing on said base.

7. A system as recited in claim 6, the means for adjusting said supporting further comprising a thrust bearing for said drive shaft on said base, and a thrust washer between said compression spring lower end and said thrust bearing.

8. A system as recited in claim 5, and means for preventing seizing between said rotor and housing, including means for aiding the rotor to rise relative to the housing upon cessation of said rotation to the rotor.

9. A system as recited in claim 8, a second compression spring, the second compression spring being on the shaft in position for bearing down against said rotor, the means for aiding the rotor to rise including a threaded sleeve, means for adjustably fixing the threaded sleeve coaxially on said driveshaft, a nut on said threaded sleeve and having fixed thereon a downward extension, the downward extension exerting downward pressure on the second compression spring, inertia arm structure fixed on the nut, means for adjustably limiting relative rotation between the threaded sleeve and the nut, and the threads on the threaded sleeve and nut being inclined, relative to the direction of rotation of said rotor, in a direction for causing the nut and downward extension to rise and relieve said pressure on the second compression spring in response to continued rotation of the nut by inertia of said inertia arm structure, upon said cessation of rotation of the rotor.

10. A system as recited in claim 5, means for retarding seizing of said rotor, comprising structure defining opening along said rotor and extending therethrough.

11. A system as recited in claim 10, said opening defined by said rotor including at least one slot inclined at an angle to said axis.

* * * * *